US006715907B2

(12) United States Patent
Manabe

(10) Patent No.: US 6,715,907 B2
(45) Date of Patent: Apr. 6, 2004

(54) METHOD OF DETERMINING REFLECTIVE SURFACE OF REFLECTOR IN VEHICLE LAMP, AND VEHICLE LAMP

(75) Inventor: Toyoyuki Manabe, Shimizu (JP)

(73) Assignee: Koito Manufacturing Co., Ltd., Tokyo (JP)

( * ) Notice: Subject to any disclaimer, the term of this patent is extended or adjusted under 35 U.S.C. 154(b) by 0 days.

(21) Appl. No.: 10/076,581

(22) Filed: Feb. 19, 2002

(65) Prior Publication Data

US 2002/0159271 A1 Oct. 31, 2002

(30) Foreign Application Priority Data

Feb. 20, 2001 (JP) ..... P2001-043721

(51) Int. Cl.[7] ..... F21V 7/00

(52) U.S. Cl. ..... 362/518; 362/297; 362/304; 362/346; 362/348; 362/517

(58) Field of Search ..... 362/517, 518, 362/297, 346, 348, 304

(56) References Cited

U.S. PATENT DOCUMENTS 4,916,585 A * 4/1990 Nino ..... 362/61
4,959,757 A 9/1990 Nakata
5,577,833 A * 11/1996 English et al. ..... 362/297
5,876,114 A * 3/1999 Nino ..... 362/518
6,045,245 A * 4/2000 Kanou ..... 362/518
6,224,246 B1 * 5/2001 Natsume et al. ..... 362/518
6,280,064 B1 * 8/2001 Sato et al. ..... 362/348
6,361,195 B1 * 3/2002 Natsume ..... 362/518
6,409,369 B1 * 6/2002 DeLamberterie ..... 362/518
6,419,381 B2 * 7/2002 Nino et al. ..... 362/518
6,454,443 B2 * 9/2002 Natsume et al. ..... 362/297
6,474,845 B1 * 11/2002 Mabe et al. ..... 362/296
6,493,096 B1 * 12/2002 Maeda et al. ..... 356/612
6,505,961 B2 * 1/2003 Natsume ..... 362/460
6,527,425 B1 * 3/2003 Nakata ..... 362/516
6,565,250 B2 * 5/2003 Kawashima et al. ..... 362/578

FOREIGN PATENT DOCUMENTS

JP 2000-215711 A 8/2000

* cited by examiner

*Primary Examiner*—Sandra O'Shea
*Assistant Examiner*—Jacob Y. Choi
(74) *Attorney, Agent, or Firm*—Sughrue Mion, PLLC

(57) ABSTRACT

A reflective surface outline 100, on which there are restrictions due to requirements from a vehicle body constitution perspective and a design perspective, is set as a basic condition for reflective surface determination, and in addition segmentation conditions and reflection conditions are set. Then, based on these various conditions, the inside of the reflective surface outline 100 is segmented along the X-axis, which is set as a segmentation axis, to produce a plurality of reflection regions, and furthermore segment surfaces 110, 121 to 151 and 122 to 152 corresponding to the reflection regions are created based on reflection angles which have been set for the reflection regions. A surface shape for the reflective surface 10*a* as a whole satisfying a required light distribution condition is then determined from these segment surfaces. As a result, a method of determining the reflective surface of a reflector in a vehicle lamp, and a vehicle lamp, are realized for which light from a light source can be utilized effectively as reflected light and a reflective surface that satisfies a required light distribution condition can be determined efficiently.

4 Claims, 7 Drawing Sheets

METHOD OF DETERMINING REFLECTIVE SURFACE OF REFLECTOR IN VEHICLE LAMP, AND VEHICLE LAMP

BACKGROUND OF THE INVENTION

1. Field of the Invention

The present invention relates to a method of determining a reflective surface of a reflector of a vehicle lamp used in a vehicle such as an automobile, and a vehicle lamp.

2. Related Background Art

Regarding a vehicle lamp, in addition to (1) conditions relating to functionality as a lamp, because the vehicle lamp is used installed in a vehicle such as an automobile, there are also (2) conditions relating to shape (shape constraints) and (3) conditions relating to external appearance (appearance constraints). There are thus demands to realize a lamp fixture for which the conditions relating to functionality are optimized after given shape constraints and appearance constraints have been satisfied.

Regarding conditions from a functionality perspective, it is required that the lamp fixture gives a suitable light distribution pattern in accordance with the type of lamp fixture, for example light uniformity in which the whole of the lamp fixture emits light uniformly, or light diffusivity in which light is suitably diffused and can be seen from various directions may be required.

Moreover, with regard to constraints from a vehicle or vehicle body perspective, examples of shape constraints are conditions due to the volume and shape of the lamp fixture housing of the vehicle body and conditions due to the shape of the outer surface of the lamp fixture (the outer surface of the lens) having to be continuous with other parts of the vehicle body. Moreover, examples of appearance constraints are conditions due to requirements from a vehicle body design perspective and requirements that the external appearance of the lamp fixture be in harmony with the external appearance of other parts of the vehicle body.

SUMMARY OF THE INVENTION

In recent years, as designability of vehicles has improved, vehicle lamps that conform to yet more constraints from a vehicle body perspective, in accordance with the individual form of the vehicle, the type of lamp fixture (illuminating lamp, indicator lamp etc.) and so on, have come to be required. One such constraint from a vehicle body perspective is that the area and shape of indicator lamps such as front turn signal lamps on the vehicle body may be constrained from the perspective of the overall constitution of the vehicle body and a design perspective.

However, indicator lamps such as front turn signal lamps have a function of indicating the presence of the vehicle and the drivers' intentions to people outside the vehicle. As a functional condition of an indicator lamp, it is thus required that the indicator lamp has a light distribution pattern such that light is emitted spread out over a prescribed range, so that the indicator lamp can be seen by people in various positions relative to the vehicle. If constraints from a vehicle body perspective as described above such as the indicator lamp having to occupy only a small area become strict, then it will be difficult to design an indicator lamp satisfying the required light distribution pattern conditions.

Specifically, a vehicle lamp is composed of a light source (light source bulb) disposed in a prescribed light source position, a reflector that reflects light from the light source bulb in the direction of an optical axis, and a lens that transmits the reflected light from the reflector and emits this reflected light to the outside. In a vehicle lamp having such a constitution, the light distribution pattern of the light emitted from the lamp fixture is controlled primarily by the surface shape of the reflective surface of the reflector that reflects the light from the light source bulb, and the shape of the lens through which the light passes.

However, if the area occupied by an indicator lamp on the vehicle body is restricted, then the total area of the reflective surface of the reflector will be restricted, and hence the solid angle of the reflective surface when viewed from the light source will become smaller. In the case of such an indicator lamp, to realize the conditions required of the light distribution pattern (the light distribution condition), it is necessary to utilize the light incident from the light source on the reflective surface at the restricted solid angle effectively as reflected light, and thus control the light distribution pattern obtained.

To solve the above problems, it is an object of the present invention to provide a method of determining the reflective surface of a reflector in a vehicle lamp, and a vehicle lamp, for which light from a light source is utilized effectively as reflected light and a reflective surface that satisfies a required light distribution condition can be determined efficiently.

To attain this object, the method of determining a reflective surface of a reflector used in a vehicle lamp according to the present invention comprises: (1) a basic condition setting step of setting basic conditions including a light source position in which a light source is disposed, an optical axis that is the direction in which light from the light source is reflected by a reflective surface of a reflector, and a reflective surface outline of the reflective surface as viewed from the direction of the optical axis; (2) a segmentation condition setting step of setting segmentation conditions including a segmentation axis that is perpendicular to the optical axis and designates the direction in which the inside of the reflective surface outline is segmented into a plurality of reflection regions, and a number of segments into which the inside of the reflective surface outline is segmented along the segmentation axis; (3) a reflection condition setting step of setting reflection conditions for each of the plurality of reflection regions, including a reflection angle that designates the direction in which light from the light source is reflected by a segment surface that forms the reflective surface in that reflection region in terms of the angle in the direction of the segmentation axis as viewed from the optical axis, and a solid angle condition that the solid angle of the segment surface when viewed from the light source should satisfy; and (4) a reflective surface determining step of, based on the basic conditions, the segmentation conditions and the reflection conditions, segmenting the inside of the reflective surface outline to generate the plurality of reflection regions, creating a surface shape of the segment surface corresponding to each of the plurality of reflection regions, and determining a surface shape that satisfies a prescribed light distribution condition for the whole of the reflective surface composed of the segment surfaces.

In the above-mentioned method of determining the reflective surface of a reflector in a vehicle lamp, firstly the reflective surface outline, on which there are restrictions due to requirements from a vehicle body constitution perspective and a design perspective, is set as a basic condition for reflective surface determination, with it specifically being the area and shape of the reflective surface as viewed from the direction of the optical axis that are set, and furthermore segmentation conditions and reflection conditions are set in accordance with the basic conditions such as this reflective surface outline. Then, based on these various conditions, the inside of the reflective surface outline is segmented along a segmentation axis to produce a plurality of reflection regions, a segment surface is created for each reflection region, and a surface shape for the reflective surface as a whole satisfying a required light distribution condition is determined.

According to such a reflective surface determination method, the reflection conditions on reflection of light from the light source by the reflective surface, and the light distribution pattern obtained from the reflected light, can be controlled separately for each of the segmented reflection regions and segment surfaces. Moreover, correlations in the reflection conditions and light distribution patterns between the segment surfaces can be controlled by setting correlations in advance in the reflection conditions such as the reflection angles set for the reflection regions. As a result, a reflective surface determination method is realized for which it is possible to utilize light from the light source more effectively in the reflection at the reflective surface, and a reflective surface that satisfies the required light distribution condition can be obtained efficiently.

Moreover, the vehicle lamp according to the present invention comprises a light source, a reflector having a reflective surface that reflects light from the light source in the direction of a prescribed optical axis, and a lens through which light reflected by the reflective surface passes, wherein the reflective surface of the reflector is such that the inside of a reflective surface outline is segmented into a plurality of reflection regions along a segmentation axis that is perpendicular to the optical axis by a plurality of segmentation lines that are approximately perpendicular to the optical axis and the segmentation axis, and, for each of the plurality of reflection regions, a surface shape of a segment surface which forms the reflective surface in that reflection region is formed in a surface shape having as a reflection axis the direction of a reflection angle in the direction of the segmentation axis as viewed from the optical axis, with the reflection angle being set for each of the reflection regions.

According to the vehicle lamp having such a constitution, the light distribution pattern due to each segment surface and the correlations between these light distribution patterns can be controlled easily and suitably. It is thus possible to reliably obtain a reflector for which the light distribution pattern due to the whole of the reflective surface made up of the plurality of segment surfaces satisfies a required light distribution condition, and a vehicle lamp having this reflector.

The present invention will be more fully understood from the detailed description given hereinbelow and the accompanying drawings, which are given by way of illustration only and are not to be considered as limiting the present invention.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will be apparent to those skilled in the art from this detailed description.

DESCRIPTION OF THE PREFERRED EMBODIMENTS

Figure 1:
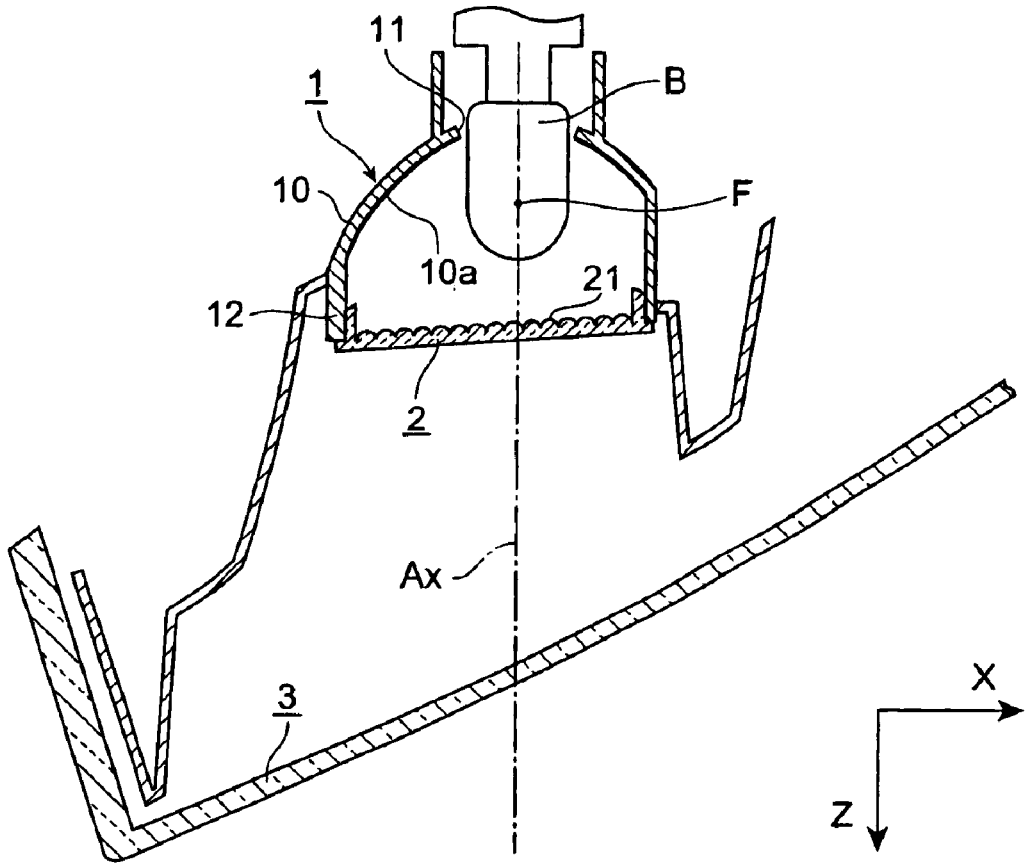
FIG. 1 is a horizontal sectional view showing the constitution of an embodiment of a vehicle lamp.

Following is a detailed description of preferred embodiments of the method of determining the reflective surface of a reflector in a vehicle lamp, and the vehicle lamp according to the present invention, with reference to the drawings. Note that equivalent constituent elements are given the same reference numeral in the description of the drawings, and redundant repeated description is omitted. Moreover, the dimensional ratios in the drawings do not necessarily match those in the description.

Firstly, a description will be given of the overall constitution of the vehicle lamp according to the present invention. Note that the embodiment shown below as an example of the vehicle lamp is a front turn signal lamp, i.e. an indicator lamp provided at the front of the body of an automobile.

Figure 2:
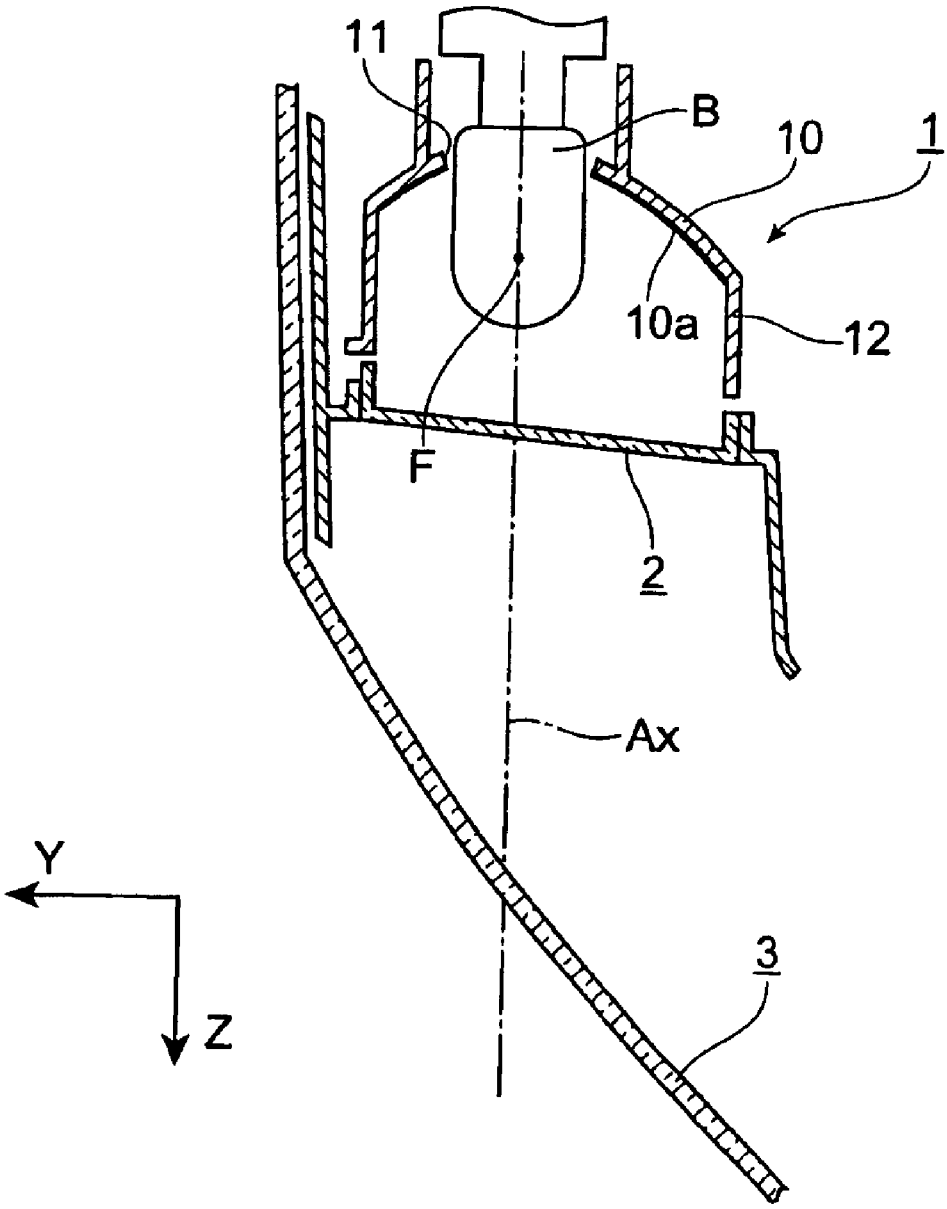
FIG. 2 is a vertical sectional view showing the constitution of the vehicle lamp shown in FIG. 1.

FIG. 1 is a horizontal sectional view showing the constitution of an embodiment of the vehicle lamp according to the present invention. FIG. 2 is a vertical sectional view showing the constitution of the vehicle lamp shown in FIG. 1. These sectional views each show the sectional structure of the lamp fixture at a plane including a light source point F and an optical axis Ax that passes through the light source point F, described below.

In the following, the left/right direction of the lamp fixture is referred to as the X-axis, the up/down direction as the Y-axis, and the forward/backward direction, which is the direction of the optical axis Ax, as the Z-axis; the X-axis and Z-axis are shown in FIG. 1 and the Y-axis and Z-axis in FIG. 2. The optical axis Ax, which designates the direction in which light is emitted from the vehicle lamp, is set in advance in accordance with the positional relationship between the lamp and the vehicle body in which the lamp is installed, the light distribution condition required of the lamp and so on.

The vehicle lamp of the present embodiment comprises a reflector 1, an inner lens 2 and an outer lens 3.

The reflector 1 has a reflector part 10, and an outer frame part 12 that is provided on an outer rim part of the reflector part 10 and is used for aligning the reflector 1 with the lenses, fixing the reflector 1 in position and so on. The reflector 1 is formed so as to spread out in a direction approximately perpendicular to the optical axis Ax. The surface on the front side of the reflector part 10 facing the inner lens 2 and the outer lens 3 is made to be a reflective surface 10*a* that reflects light from the light source in the direction of the optical axis Ax.

Moreover, a light source inserting hole 11 is formed in a prescribed position in the reflector part 10, and a light source bulb B is inserted into this light source inserting hole 11 from the back of the reflector 1. The light source bulb B is fixedly installed relative to the reflector 1 such that the light source point F of the light source bulb B is in a prescribed position (the light source position) on the optical axis Ax.

The two lenses, namely the inner lens 2 and the outer lens 3, are provided in this order in the direction of light emission, which is designated by the optical axis Ax, relative to the light source bulb B and the reflector 1.

The inner lens 2 is a lens that, a long with the reflector 1, controls the emission conditions of the light emitted from the lamp, such that a light distribution pattern that satisfies a prescribed light distribution condition is obtained. The inner lens 2 is installed approximately perpendicular to the optical axis Ax. In the constitution example shown in FIGS. 1 and 2, a lens on which lens steps 21 that have a function of diffusing light in the X-axis direction and have the Y-axis direction as their longitudinal direction are formed on the surface of the lens on the side of the reflector 1 is used as the inner lens 2, as shown schematically in FIG. 1.

Moreover, the outer lens 3 is a lens that constitutes the outer surface of the lamp, and also constitutes part of the outer surface of the vehicle body when the lamp fixture is installed in the vehicle body. In the constitution example shown in FIGS. 1 and 2, a plain transparent lens having no lens steps and thus no light-diffusing function is used as the outer lens 3. In the present constitution example, the outer lens 3 thus has virtually no effect on the emission conditions of the light from the lamp. Moreover, the shape of the outer surface of the outer lens 3 is determined, based on the design of the vehicle body, so as to be continuous with the outer surface of other parts of the vehicle body.

With the above constitution, when the light source bulb B is turned on, light supplied from a light emission region consisting of the light source point F of the light source bulb B and the vicinity thereof is incident on the reflective surface 10*a* of the reflector 1, and is reflected in the direction of the optical axis Ax according to prescribed reflection conditions. The reflected light from the reflective surface 10*a* is then diffused while passing through the inner lens 2 so as to produce the prescribed emission conditions, and is finally emitted to the outside of the lamp via the outer lens 3.

A description will now be given of the constitution of the reflective surface of the reflector in the vehicle lamp.

Figure 3:
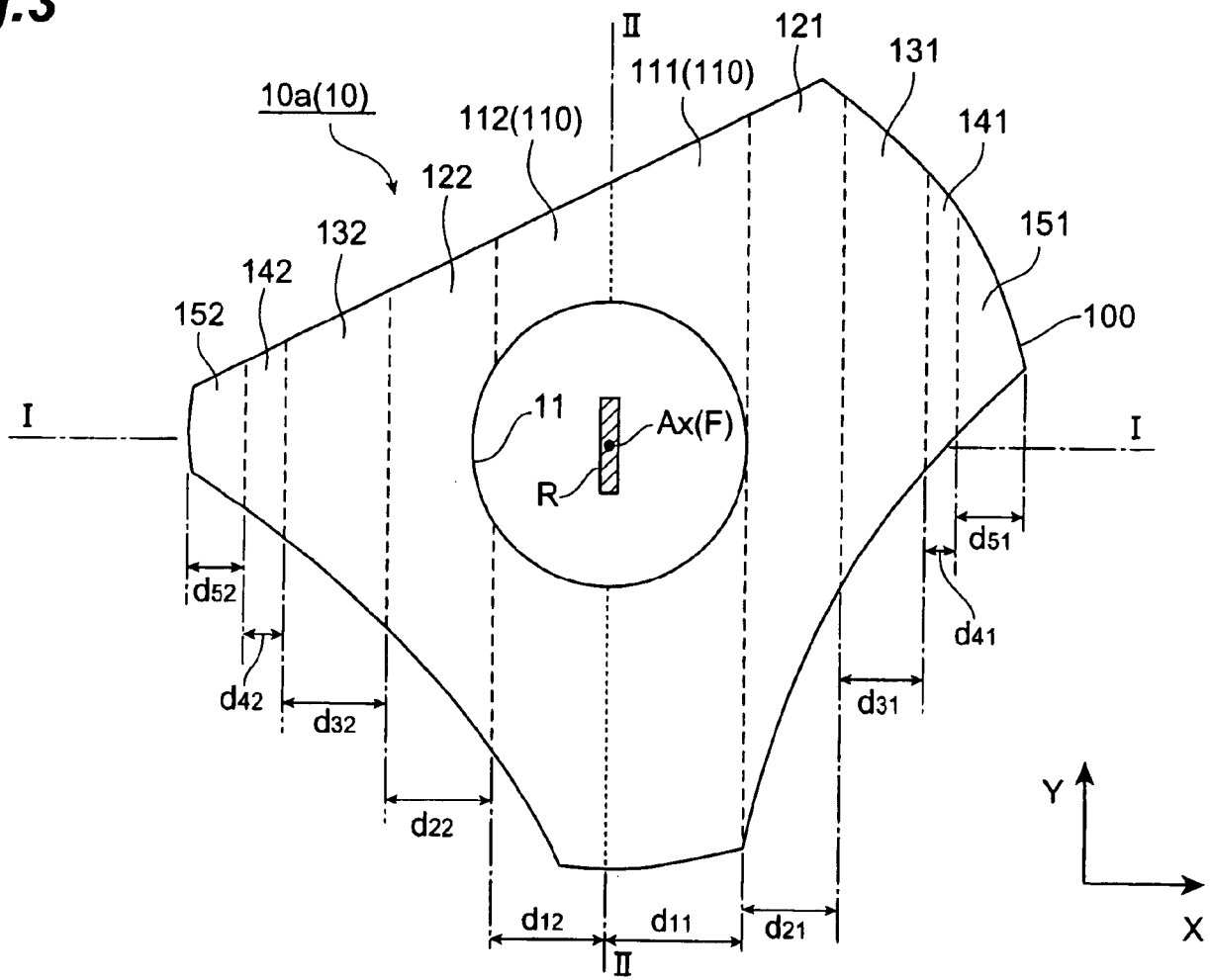
FIG. 3 is a front view showing the constitution of the reflective surface of the reflector in the vehicle lamp shown in FIGS. 1 and 2.

FIG. 3 is a plan view showing the constitution of the reflective surface of the reflector in the vehicle lamp shown in FIGS. 1 and 2. This plan view shows the constitution of the reflective surface 10*a* (the reflector part 10) of the reflector 1 viewed from the direction of the optical axis Ax (the front). Note that FIG. 1 described above is a horizontal sectional view along the line I—I in the X-axis direction in the plan view of FIG. 3, and FIG. 2 is a vertical sectional view along the line II—II in the Y-axis direction in the plan view of FIG. 3.

The reflective surface 10*a*, which is the surface of the reflector part 10 facing the lenses 2 and 3, has a constitution in which the inside of the reflective surface outline 100 thereof is segmented into a plurality of reflection regions along a segmentation axis, with the segmentation axis being the X-axis, which is perpendicular to the optical axis Ax.

In FIG. 3, the inside of the reflective surface outline 100 is segmented into the plurality of reflection regions by a plurality of segmentation lines that are shown as dashed lines and are approximately perpendicular to the optical axis (the Z-axis) and the segmentation axis (the X-axis), and approximately parallel to the Y-axis. In each of the reflection regions is formed a segment surface that is the reflective surface in that reflection region; the plurality of segment surfaces together make up the whole of the reflective surface 10*a*.

Specifically, in the case of the reflective surface 10*a* shown in FIG. 3, each of the region on the right side of the light source point F (the optical axis Ax) and the region on the left side of the light source point F (the optical axis Ax) inside the reflective surface outline 100 is segmented into five reflection regions. Corresponding to the reflection regions, on the right side of the light source point F are provided, from the light source outwards, five segment surfaces 111, 121, 131, 141 and 151. Moreover, on the left side of the light source point F are provided, from the light source outwards, five segment surfaces 112, 122, 132, 142 and 152.

The segment surfaces 111 and 112 closest to the light source on the right and left respectively together form a segment surface 110 (a single reflection region) that constitutes the central part of the reflective surface 10*a*. With the reflective surface 10*a*, overall the inside of the reflective surface outline 100 is thus segmented into nine reflection regions, and the corresponding nine segment surfaces 110, 121 to 151, and 122 to 152 together constitute the reflective surface 10*a*.

Moreover, an approximately circular opening that forms the light source inserting hole 11 for installing the light source bulb B is provided in a central part of the reflective surface 10*a* centered on the optical axis Ax. With the actual reflective surface 10*a*, the central segment surface 110 is thus divided into two parts, the upper part and the lower part, with the light source inserting hole 11 therebetween.

A description will now be given of the specific constitution of the vehicle lamp and the reflective surface of the reflector shown in FIGS. 1 to 3, along with a method of determining the reflective surface of the reflector (design method).

Figure 4:
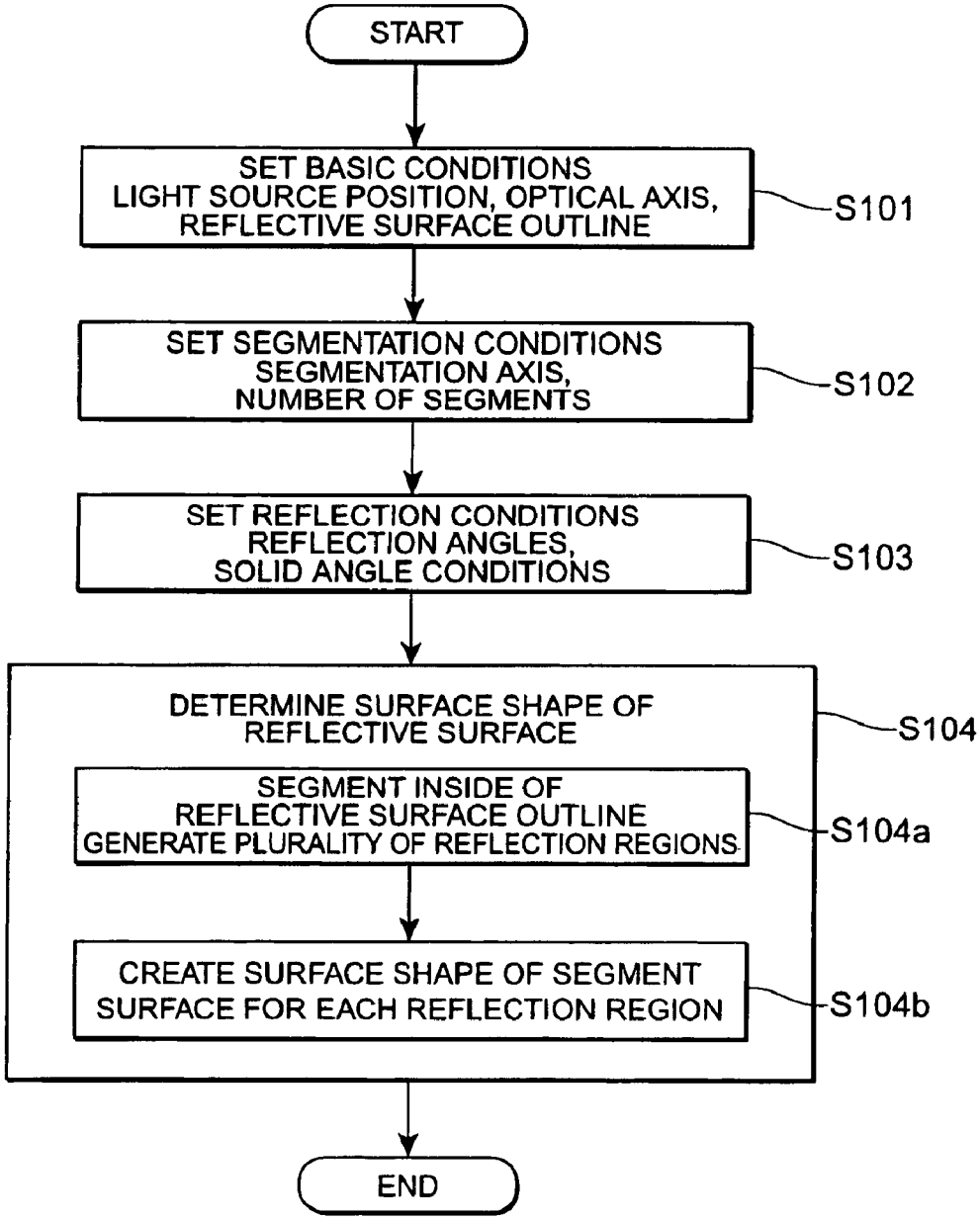
FIG. 4 is a flowchart showing in outline form an embodiment of a method of determining the reflective surface of a reflector in a vehicle lamp.

FIG. 4 is a flowchart showing in outline form an embodiment of the method of determining the reflective surface of a reflector in a vehicle lamp according to the present invention. This reflective surface determination method has a basic condition setting step S101, a segmentation condition setting step S102, a reflection condition setting step S103, and a reflective surface determining step S104. Following is a description of these steps, referring to the constitution of the reflective surface 10*a* shown in FIG. 3.

Basic Condition Setting Step (Step S101)

In the determination of the reflective surface of a reflector used in a vehicle lamp, firstly basic conditions, which are conditions basic to the creation of the surface shape of the reflective surface are set.

As basic conditions, for example the position in which the light source bulb B is installed and the position of the light source point F (the light source position), the optical axis Ax, which passes through the light source position and is the direction in which light is emitted from the lamp after being reflected from the light source by the reflective surface 10*a* of the reflector 1, and so on are set.

Moreover, the reflective surface outline 100, which is the outline of the reflective surface 10*a* as viewed from the direction of the optical axis Ax, is also set as a basic condition. The specific area inside and shape of the reflective surface outline 100, of which an example is shown in FIG. 3, are set based on shape constraints due to the volume and shape of the lamp fixture housing of the vehicle body and the positional relationship with other parts of the vehicle body and other lamp fixtures and so on, appearance constraints due to requirements from a vehicle body design perspective, and so on.

Other conditions may also be set as basic conditions as required. Such conditions may include, for example, the shape of the light-emitting region of the light source bulb B used as the light source. As an example of the shape of the light-emitting region of the light source, a light-emitting region R set to have a shape in which the Y-axis direction perpendicular to the optical axis Ax (the Z-axis) and the segmentation axis (the X-axis) is the longitudinal direction is shown in FIG. 3. Such a shape of the light-emitting region R corresponds, for example, to the filament shape in the case that a bulb for which a long (laterally oriented) filament is the light-emitting region is used as the light source bulb B.

Moreover, separate to the various conditions described above that are set as basic conditions, light distribution conditions, which are conditions that the light distribution pattern due to the light emitted from the vehicle lamp should satisfy, and soon are given in advance.

Segmentation Condition Setting Step (Step S102)

Next, segmentation conditions, which are conditions on segmenting the inside of the reflective surface outline 100 and thus generating the plurality of reflection regions, are set.

As segmentation conditions, for example a segmentation axis that is perpendicular to the optical axis Ax and designates the direction in which the inside of the reflective surface outline 100 is segmented into the plurality of reflection regions, the number of segments into which the inside of the reflective surface outline 100 is segmented along the segmentation axis, and so on are set. In the constitution example shown in FIG. 3, the X-axis, which is in the horizontal direction of the vehicle body, is set as the segmentation axis, as described above. Moreover, the number of segments of the inside of the reflective surface outline 100 is set to 9, i.e. 1 central+4 right+4 left.

Reflection Condition Setting Step (Step S103)

Next, reflection conditions, which are conditions for creating the surface shape of the segment surface for each of the plurality of reflection regions, are set.

As reflection conditions, for example, for each of the plurality of reflection regions, a reflection angle that designates the direction in which light from the light source is reflected by the segment surface that forms the reflective surface 10*a* in that reflection region, and a solid angle condition that the solid angle of the segment surface when viewed from the light source should satisfy, and so on are set.

Figure 5:
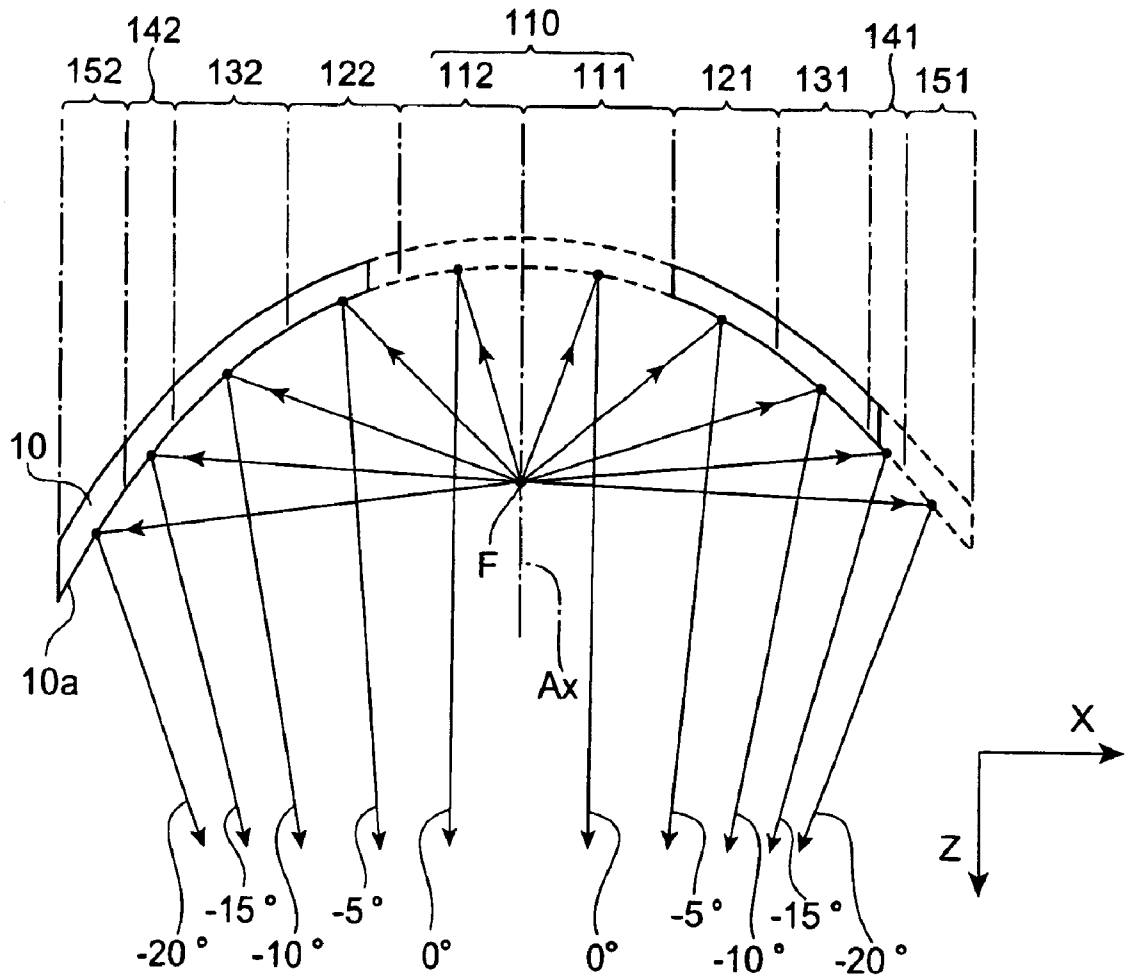
FIG. 5 is a horizontal sectional view showing reflection angles set for the reflective surface of the reflector shown in FIG. 3.

FIG. 5 is a horizontal sectional view showing reflection angles set for the reflective surface 10*a* of the reflector 1 shown in FIG. 3. In FIG. 5, the reflective surface 10*a* of the reflector part 10 is illustrated by means of a sectional view along the line I—I shown in the plan view of FIG. 3 as in FIG. 1, and in addition the direction of reflection of light from the light source point F is shown for each of the segment surfaces 110 (111+112), 121 to 151 and 122 to 152 that make up the reflective surface 10*a*. These light reflection directions for the segment surfaces correspond to the reflection angles set for the reflection regions when setting the surface shape of the reflective surface 10*a*.

The reflection angle of light from the light source is set for each of the reflection regions in terms of the angle in the X-axis direction (the segmentation axis direction) as viewed from the optical axis Ax. Here, regarding the reflection angle of light reflected from each reflection point on the reflective surface 10*a*, angles for which the reflected light is emitted in a direction so as to move away from the optical axis Ax that passes through the light source point F are defined to be positive reflection angles, and angles for which the reflected light is emitted in a direction towards the optical axis Ax (i.e. so as to cross the optical axis Ax) are defined to be negative reflection angles.

For the reflective surface 10*a* in the present embodiment, the reflection angle is set to 0 or a negative angle as viewed from the optical axis Ax for all of the nine reflection regions corresponding to the nine segment surfaces 110, 121 to 151 and 122 to 152, as shown in FIG. 5. Specifically, from the light source point F outwards, the reflection angles for the reflection regions are set to 0° for the segment surface 110 (the segment surfaces 111 and 112), −5° for the segment surfaces 121 and 122, −10° for the segment surfaces 131 and 132, −15° for the segment surfaces 141 and 142, and −20° for the segment surfaces 151 and 152.

Moreover, the solid angle conditions for the segment surfaces are set through conditions on the permissible numerical range for the solid angle for each individual segment surface, or conditions on the ratio (balance) of the solid angles between a plurality of segment surfaces, or the like, referring when doing this to the area inside and shape of the reflective surface outline 100, the required light distribution condition and so on.

Moreover, the f-value (focal length) for a prescribed part of the reflective surface 10*a*, for example the central part, may similarly be set as a reflection condition. Setting of the f-value of the reflective surface 10*a* is basically done through the optical structure of the lamp fixture, but it is preferable to also give consideration to the effects of heat generated by the light source bulb B on the reflector 1 and the inner lens 2.

Reflective Surface Determining Step (Step S104)

Next, a surface shape of the reflective surface that satisfies the prescribed light distribution condition is set based on the basic conditions, the segmentation conditions and the reflection conditions. In the present embodiment, the reflective surface determining step S104 includes a reflection region generating step S104*a* and a segment surface creating step S104*b*, as described below.

Reflection Region Generating Step (Step S104*a*)

Firstly, referring to the number of segments and the solid angle conditions that have been set, the inside of the reflective surface outline 100 is segmented along the segmentation axis, thus generating the plurality of reflection regions.

In the constitution example shown in FIG. 3, the inside of the reflective surface outline 100 is segmented by a plurality of segmentation lines that are approximately perpendicular to the optical axis Ax and the segmentation axis, thus generating nine reflection regions, as described earlier. Here, the positions of the segmentation lines and thus the widths of the segment surfaces—in the example in FIG. 3 the widths $d_{11}$ to $d_{51}$ of the segment surfaces 111 to 151 on the right side and the widths $d_{12}$ to $d_{52}$ of the segment surfaces 112 to 152 on the left side—are set referring to the solid angle conditions that have been set as reflection conditions, and so on.

Specifically, the solid angle when viewed from the light source of the segment surface corresponding to each of the plurality of reflection regions generated by segmenting with the segmentation lines depends on the area and shape of each of the reflection regions generated by segmenting the inside of the reflective surface outline 100 in the XY plane. At the stage of segmenting the inside of the reflective surface outline 100, the segmentation lines are thus set in positions for which it is anticipated that segment surfaces satisfying the solid angle conditions will be obtained, and then the plurality of reflection regions are generated.

Segment Surface Creating Step (Step S104*b*)

Next, referring to the reflection angles that have been set, the surface shape of the segment surface corresponding to each of the plurality of reflection regions is created.

In the constitution example shown in FIG. 3, the surface shape of each of the nine segment surfaces 110, 121 to 151 and 122 to 152 is created such that the direction of reflection of light from that segment surface is the direction of the reflection angle that has been set for the corresponding one of the nine reflection regions. Specifically, for each of the reflection regions, the surface shape of the corresponding segment surface is created taking the direction of the reflection angle set for that reflection region as the reflection axis (the optical axis that is the direction in which light from the light source is reflected by that part of the reflective surface).

Once the surface shape of the segment surface corresponding to each of the nine reflection regions has been created as described above, the overall surface shape of the reflective surface 10*a* satisfying the required light distribution condition is determined as the aggregate of the nine segment surfaces 110, 121 to 151 and 122 to 152 obtained.

Note that after the surface shape of the reflective surface 10*a* has been determined, the surface shape may be further modified if required. An example of such modification is creating diffusing steps on each of the segment surfaces of the reflective surface 10*a* to add a light-diffusing function to the reflection of the light from the light source.

Note, however, that in the embodiment shown in FIGS. 1 to 3, the inner lens 2 is provided with light-diffusing lens steps 21 as described earlier (see FIG. 1), and hence diffusing steps are not created on the reflective surface 10*a*. Moreover, regarding the structure of the lens steps 21, it is preferable to set the pitch and the like of the steps while giving consideration to the determined surface shape of the reflective surface 10*a* and the reflection conditions. Moreover, regarding the pitch of the steps, if necessary the inner lens 2 may comprise a plurality of lens regions each having the steps formed at a different pitch.

A description will now be given of the effects of the method of determining the reflective surface of a reflector in a vehicle lamp, and the vehicle lamp, described above.

In the method of determining the reflective surface of a reflector of a vehicle lamp according to the present embodiment, firstly basic conditions for reflective surface determination such as the reflective surface outline 100, which has restrictions thereon due to requirements from a vehicle body constitution perspective and a design perspective, are set, specifically the area inside and shape of the reflective surface 10*a* as viewed from the direction of the optical axis, and then segmentation conditions and reflection conditions are set in accordance with the basic conditions such as the reflective surface outline 100 and the like. Based on these various conditions, the inside of the reflective surface outline 100 is then segmented into a plurality of reflection regions along the X-axis, which is taken as the segmentation axis, a segment surface is created for each reflection region, and a surface shape of the reflective surface 10*a* as a whole that satisfies the required light distribution condition is determined.

According to this reflective surface determination method, the reflection conditions on reflection of light from the light source by the reflective surface, and the light distribution pattern obtained from the reflected light, can be controlled separately for each of the segmented reflection regions and segment surfaces. Moreover, correlations in the reflection conditions and light distribution patterns between the segment surfaces can be controlled by setting correlations in advance in the reflection conditions such as the reflection angles set for the reflection regions. As a result, a reflective surface determination method is realized for which light from a light source can be utilized more effectively in the reflection at the reflective surface, and a reflective surface that satisfies the required light distribution condition can be obtained efficiently.

In particular, in recent years, as designability of vehicles has improved, cases have arisen in which there are severe constraints on the area and shape of lamp fixtures such as indicator lamps from the perspective of the overall constitution of the vehicle body and a design perspective. For example, in the example shown in FIG. 3, another lamp fixture (for example a headlamp) is disposed near to the lamp fixture shown (for example a front turn signal lamp), and hence there are severe constraints on how much the reflective surface 10*a* can extend in the downward/rightward direction and the downward/leftward direction. However, according to the constitution of the reflective surface determination method and reflective surface 10*a* described above, a reflective surface 10*a* that satisfies required light distribution conditions can be produced efficiently even when there are such severe constraints.

Moreover, regarding the constitution of the reflective surface 10*a* of the reflector 1, the inside of the reflective surface outline 100 is segmented into the plurality of reflection regions by a plurality of segmentation lines that are approximately perpendicular to each of the optical axis Ax (the Z-axis) and the segmentation axis (the X-axis), and taking the direction of the reflection angle at each of the reflection regions as a reflection axis, the surface shape of the segment surface for each of the reflection regions is created.

According to this constitution, the light distribution pattern due to each of the segment surfaces, and the correlations between these light distribution patterns, can be easily and suitably controlled. As a result, a reflector for which the light distribution pattern due to the whole reflective surface made up of the plurality of segment surfaces satisfies the required light distribution condition, and a vehicle lamp having this reflector, can be obtained reliably.

Moreover, the reflection angle for each of the plurality of reflection regions (the plurality of segment surfaces 110, 121 to 151 and 122 to 152) is set so as to be zero or a negative angle as viewed from the optical axis.

In this case, the segment surface in each of the reflection regions becomes either the same as the reflective surface for when the reflection angle relative to the optical axis Ax for the whole reflective surface 10*a* is made to be zero (a normal paraboloid), or a surface closer to the light source than this. As a result, compared with when the reflection angles are set to be positive angles, the solid angles of the segment surfaces when viewed from the light source can be made to be bigger, and hence the efficiency of utilization of the light from the light source can be improved.

Figure 6:
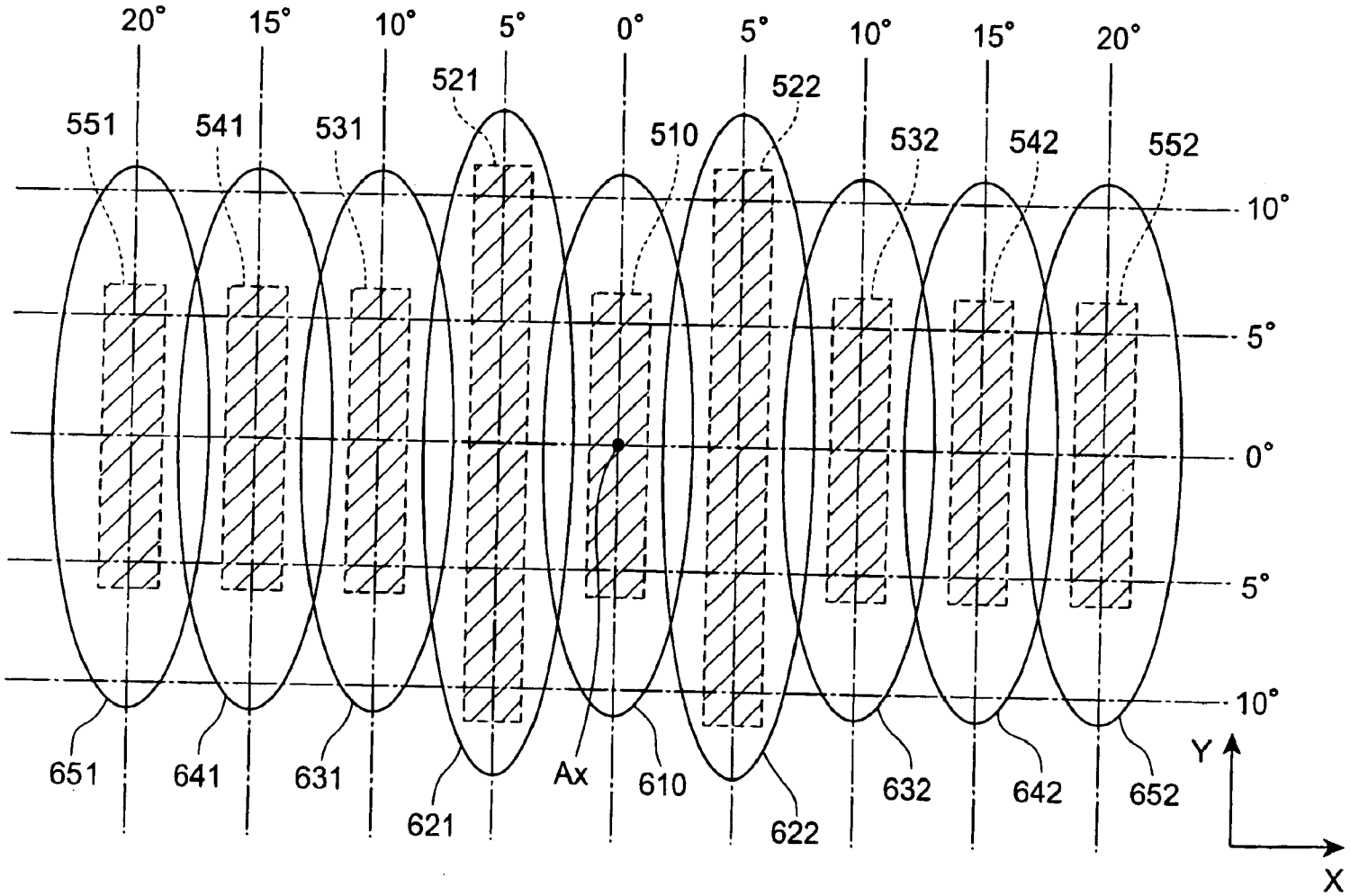
FIG. 6 is a diagram showing schematically the light distribution pattern obtained from the reflective surface of the reflector shown in FIGS. 3 and 5.

FIG. 6 is a diagram showing schematically the light distribution pattern obtained from the reflective surface 10*a* of the reflector 1 shown in FIGS. 3 and 5. In this light distribution pattern diagram, the light distribution pattern as viewed from the direction of the optical axis Ax (the front), as in FIG. 3 which shows the planar structure of the reflective surface 10*a*, is shown schematically in terms of the angle distribution thereof, with the horizontal axis showing the angle of emission of the light in the X-axis direction, and the vertical axis showing the angle of emission of the light in the Y-axis direction. Of these, the angle of emission shown on the horizontal axis corresponds to the reflection angle set for each of the reflection regions (each of the segment surfaces).

Note that in the case of the vehicle lamp and reflector 1 of the present embodiment, as described above with regard to FIG. 5, a negative reflection angle is set for each segment surface, and hence the reflected light from the reflective surface 10*a* crosses the optical axis Ax and exits on the opposite side of the optical axis Ax. As a result, in the light distribution pattern of FIG. 6, the patterns due to the right side segment surfaces 111 to 151 appear on the left side, and the patterns due to the left side segment surfaces 112 to 152 appear on the right side.

The nine light distribution patterns shown in FIG. 6 by the dashed lines, i.e. the central pattern 510, the left side patterns 521 to 551 and the right side patterns 522 to 552 indicate the light distribution patterns due to the reflected light from the central segment surface 110, the right side segment surfaces 121 to 151 and the left side segment surfaces 122 to 152 shown in FIG. 3, respectively, with diffusion of the light by the inner lens 2 being excluded.

The angles of emission in the X-axis direction for the patterns 510, 521 to 551 and 522 to 552 are the reflection angles 0°, 5°, 10°, 15° and 20° set as reflection conditions. That is, the range of emission of light in the direction of the segmentation axis (the X-axis) is suitably spread out in accordance with the reflection angles set for the reflection regions.

Moreover, in the embodiment described above, as shown in FIG. 3, the light source bulb B is installed such that the longitudinal direction of the shape of the light-emitting region R thereof (for example the longitudinal direction of the line segment shape of a filament) is the Y-axis direction, which is approximately perpendicular to the optical axis Ax and the segmentation axis.

The shape of the light-emitting region of the light source naturally affects the light distribution pattern obtained through reflection of the light from the light source by the reflective surface 10*a*. In the case of the light distribution patterns of FIG. 6, each pattern is spread out in the Y-axis direction, corresponding to the longitudinal direction of the shape of the light-emitting region R being made to be the Y-axis direction. That is, the range of emission of light in the Y-axis direction perpendicular to the optical axis Ax (the Z-axis) and the segmentation axis (the X-axis) is suitably spread out due to the shape and orientation of the light-emitting region R of the light source.

In this way, by setting the longitudinal direction of the shape of the light-emitting region R of the light source and the segmentation axis for segmentation of the reflective surface 10*a* to be perpendicular to each other, the spreading out of the region of emission of light in the X-axis direction and the Y-axis direction necessary for satisfying the required light distribution condition can easily be realized.

Due to the reflected light from the reflective surface 10*a* passing through the inner lens 2 and thus being diffused, the light distribution patterns 510, 521 to 551 and 522 to 552 become the nine diffused light distribution patterns shown by the solid lines in FIG. 6, i.e. the central pattern 610, the left side patterns 621 to 651, and the right side patterns 622 to 652.

The overall light distribution pattern in which are combined the nine diffused patterns 610, 621 to 651 and 622 to 652 becomes the light distribution pattern for the overall reflective surface 10*a* made up of the nine segment surfaces 110, 121 to 151 and 122 to 152. By controlling the light distribution patterns due to the individual segment surfaces such that there are relationships therebetween through the setting of the segmentation conditions and the reflection conditions, the range of emission is suitably spread out in the X-axis direction and the Y-axis direction in the overall light distribution pattern. Moreover, the necessary luminosity is secured for each of the pattern parts of the overall light distribution pattern.

That is, according to the constitution of the reflective surface 10*a* of the reflector 1 shown in FIGS. 3 and 5, a light distribution pattern can be obtained such that light from the light source is utilized effectively as reflected light and the required light distribution condition is satisfied efficiently.

The reflection angle and the solid angle (str) as viewed from the light source for each of the segment surfaces 110, 121 to 151 and 122 to 152 of the reflective surface 10*a* are as shown in Table 1 below.

TABLE 1

| Segment Surface | Reflection Angle | Solid Angle (str) | Segment Surface | Reflection Angle | Solid Angle (str) |
|---|---|---|---|---|---|
| 110 upper | 0° | 0.517 | — | — | — |
| 110 lower | 0° | 0.712 | — | — | — |
| 121 | −5° | 0.813 | 122 | −5° | 0.753 |
| 131 | −10° | 0.446 | 132 | −10° | 0.460 |
| 141 | −15° | 0.100 | 142 | −15° | 0.094 |
| 151 | −20° | 0.095 | 152 | −20° | 0.086 |

As shown in Table 1, by segmenting the inside of the reflective surface outline 100 to generate the plurality of reflection regions while referring to the solid angle conditions set as reflection conditions, a constitution is realized for which a sufficient solid angle can be obtained for each of the segment surfaces corresponding to the reflection regions. Moreover, in the example in Table 1, a suitable solid angle distribution has also been obtained in the sense that the solid angle is approximately the same for corresponding segment surfaces on either side of the light source point F.

Next, a description will be given of an example of the specific method of determining the surface shape of the reflective surface 10*a* in the reflective surface determining step S104 in the flowchart shown in FIG. 4.

As the actual procedure for determining the surface shape of the reflective surface 10*a*, in many cases a procedure is used in which the surface shape of the reflective surface is created, then the results are fed back and the surface shape is created again, and this is repeated until a reflective surface having a surface shape that sufficiently satisfies the required light distribution condition and the like is finally obtained.

A specific example of such a procedure for determining the surface shape of the reflective surface will now be described using the flowchart of FIG. 7. Note that in the following determination procedure, a method is used in which the surface shapes of the segment surfaces corresponding to the plurality of reflection regions are created in order from the reflection region on the light source side outwards.

Based on the set basic conditions, segmentation conditions and reflection conditions (step S200), determination of the surface shape of the reflective surface is started. Firstly, referring to the set number of segments (=9) and solid angle conditions, the inside of the reflective surface outline 100 is segmented by a plurality of segmentation lines that are approximately perpendicular to the optical axis Ax and the segmentation axis, thus generating nine reflection regions (S201).

Next, a surface shape is created for the segment surface 110 corresponding to the reflection region nearest to the light source which includes the optical axis Ax (S202). When creating the surface shape of the segment surface 110, the reflection angle set for this reflection region, and the f-value set for the central part of the reflective surface 10*a*, are referred to. In the constitution example described earlier, the reflection angle for this reflection region is set to 0°, and hence the surface shape of the segment surface 110 is created as a normal paraboloid having the light source point F as the focal point thereof and the optical axis Ax as the central axis thereof or the like.

Next, the surface shapes of the segment surfaces 121 to 151 and 122 to 152 for the reflection regions outside the segment surface 110 are created in order (S203). For example, regarding the surface shape of the reflective surface 10*a* to the right side of the light source point F, after the segment surface 110, the surface shape is created for the segment surface 121, which is adjacent to the segment surface 110 on the right side thereof. When creating the surface shape of the segment surface 121, the reflection angle set for this reflection region, and connection conditions set for the connection to the surface shape of the adjacent segment surface 110, are referred to.

In the constitution example described earlier, a negative reflection angle of −5° was set for the segment surface 121. A specific example of the surface shape of a segment surface for such a negative reflection angle is a paraboloid created with a negative f-value (an f-value smaller than the f-value for the segment surface 110) with the optical axis Ax as the central axis. In this case, the central axis itself of the surface shape coincides with the optical axis Ax, but by using a negative f-value, the reflection axis becomes the direction of the negative reflection angle that has been set. Moreover, it is also possible to use a paraboloid created with an axis inclined from the optical axis Ax by the set reflection angle as the central axis (the reflection axis).

After the surface shape of the segment surface 121 has been created, the surface shapes of the segment surfaces 131 to 151 are created, referring to the reflection angle and the connection conditions similarly to the segment surface 121. Moreover, the surface shapes of the segment surfaces 122 to 152 on the left side are created similarly. The surface shape created as the aggregate of the surface shapes of the nine segment surfaces 110, 121 to 151 and 122 to 152 thus obtained is then the surface shape of the reflective surface 10*a* as a whole.

Next, with regard to the surface shape of the reflective surface 10*a* thus created, it is judged whether or not each of the segment surfaces 110, 121 to 151 and 122 to 152 satisfies the solid angle condition set as a reflection condition (step S204).

The solid angle evaluation is carried out by calculating the solid angle of each of the segment surfaces as viewed from the light source. The solid angle calculation may be carried out by calculating the solid angle with the light source taken to be a point light source positioned at the light source point F, but it is also possible to carry out the solid angle calculation while considering the line segment shape of the filament of the light source bulb B, as in the case of the shape of the light-emitting region R shown in FIG. 3, or the like.

Furthermore, it is judged whether or not the light distribution pattern for the whole of the reflective surface 10*a* made up of the segment surfaces 110, 121 to 151 and 122 to 152 satisfies the required light distribution condition (step S205). The light distribution pattern evaluation is carried out using, for example, the light distribution pattern calculated by tracing of rays of light from the light source. Again, the calculation of the light distribution pattern can be carried out taking the light source either as a point light source or as a line segment shape of a filament or the like.

If it is judged that the solid angle conditions and the light distribution conditions are both satisfied, then the current surface shape of the reflective surface 10*a* is taken as the final surface shape (step S206). If, on the other hand, it is judged that at least one of the solid angle conditions and the light distribution conditions are not satisfied, then steps S201 to S203 are repeated and a new surface shape of the reflective surface 10*a* is created, before once again similarly judging whether or not the solid angle conditions and the light distribution conditions are satisfied.

Figure 7:
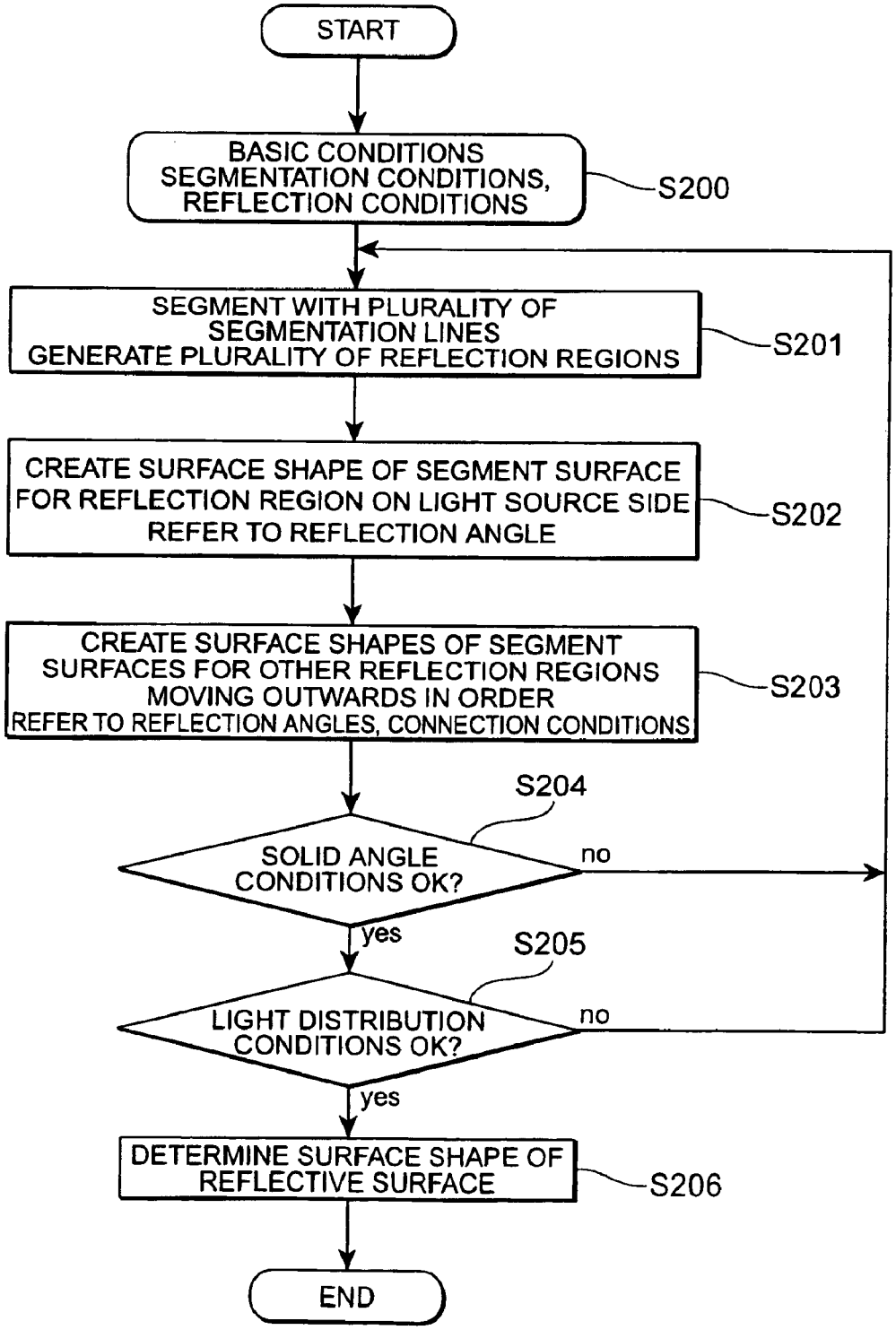
FIG. 7 is a flowchart showing a specific example of the procedure for determining the surface shape of the reflective surface.

Here, in the procedure for determining the surface shape of the reflective surface 10*a* shown in FIG. 7, the surface shapes of the segment surfaces corresponding to the plurality of reflection regions are created in order from the reflection region on the light source side outwards, such that prescribed connection conditions for adjacent segment surfaces are satisfied. As a result, in addition to the light distribution pattern for each of the segment surfaces being controlled and hence light distribution conditions, which are conditions from a functional perspective, being satisfied by the light distribution pattern for the reflective surface 10*a* as a whole, adjacent segment surfaces are also connected together suitably, and hence a reflective surface 10*a* can be obtained for which the surface shape and external appearance as a whole are suitable.

Regarding the connection conditions required of the segment surfaces, an example is the condition that connection is such that the surface shape is continuous with no steps at boundaries between segment surfaces. Moreover, regarding the order of creating the segment surfaces, in the example described above the order was from the light source side outwards, but it is also possible to create the segment surfaces in the opposite order from the reflection region on the outside to the reflection region on the light source side.

The method of determining the reflective surface of a reflector in a vehicle lamp, and the vehicle lamp, according to the present invention are not restricted to the embodiments described above, but rather various modifications are possible. For example, regarding the reflection angles set for the reflection regions (segment surfaces), in the example described above all were made to be zero or negative, but in accordance with the constitution of and light distribution conditions for the specific lamp fixture, reflection angles may also be made to be positive.

Moreover, regarding the reflection angles set for the reflection regions, it is also possible to set the reflection angles and distribution thereof in the Y-axis direction while considering the shape of the light-emitting region of the light source and the like, and then create the segment surfaces.

As described above in detail, the method of determining the reflective surface of a reflector in a vehicle lamp, and the vehicle lamp, according to the present invention can be used as a method of determining the reflective surface of a reflector in a vehicle lamp, and a vehicle lamp, for which it is possible to efficiently determine a reflective surface satisfying a certain light distribution condition. That is, according to the reflective surface determination method and the vehicle lamp for which segmentation conditions and reflection conditions are set in addition to basic conditions such as the reflective surface outline, on which there are restrictions due to requirements from a vehicle body constitution perspective and a design perspective and the like, the inside of the reflective surface outline is segmented along a segmentation axis to produce a plurality of reflection regions based on these various conditions, a segment surface is created for each reflection region, and a surface shape for the reflective surface as a whole satisfying a required light distribution condition is determined, a reflective surface determination method and a vehicle lamp are realized for which light from a light source can be utilized more effectively as reflected light and a reflective surface that satisfies a required light distribution condition can be obtained efficiently.

From the invention thus described, it will be obvious that the invention may be varied in many ways. Such variations are not to be regarded as a departure from the spirit and scope of the invention, and all such modifications as would be obvious to one skilled in the art are intended for inclusion within the scope of the following claims.

What is claimed is:

1. A method of determining a reflective surface of a reflector used in a vehicle lamp, comprising:

a basic condition setting step of setting basic conditions including a light source position in which a light source is disposed, an optical axis that is the direction in which light from said light source is reflected by a reflective surface of a reflector, and a reflective surface outline of said reflective surface as viewed from the direction of said optical axis;

a segmentation condition setting step of setting segmentation conditions including a segmentation axis that is perpendicular to said optical axis and designates the direction in which an inside of said reflective surface outline is segmented into a plurality of reflection regions, and a number of segments into which the inside of said reflective surface outline is segmented along said segmentation axis;

a reflection condition setting step of setting reflection conditions for each of said plurality of reflection regions, including a reflection angle that designates the direction in which light from said light source is reflected by a segment surface that forms said reflective surface in that reflection region in terms of the angle in the direction of said segmentation axis as viewed from said optical axis, and a solid angle condition wherein a solid angle of said segment surface when viewed from said light source is set according to said solid angle condition; and a reflective surface determining step of, based on said basic conditions, said segmentation conditions and said reflection conditions, segmenting the inside of said reflective surface outline to generate said plurality of reflection regions, creating a surface shape of said segment surface corresponding to each of said plurality of reflection regions, and determining a surface shape determined according to a prescribed light distribution condition for a whole of said reflective surface composed of said segment surfaced, wherein, in said basic condition setting step, a shape of a light-emitting region of said light source is set as one of said basic conditions such that a longitudinal direction thereof is approximately perpendicular to said optical axis, and in said segmentation condition setting step, said segmentation axis is set so as to be approximately perpendicular to the longitudinal direction of the shape of said light-emitting region.

2. The method according to claim 1, wherein said reflective surface determining step has:

a reflection region generating step of segmenting the inside of said reflective surface outline by a plurality of segmentation lines approximately perpendicular to said optical axis and said segmentation axis to generate said plurality of reflection regions, while referring to said number of segments and said solid angle conditions; and a segment surface creating step of creating the surface shape of said segment surface corresponding to each of said plurality of reflection regions with the direction of said reflection angle for that reflection region taken as a reflection axis, while referring to said reflection angles.

3. The method according to claim 1, wherein, in said reflective surface determining step, the surface shapes of said segment surfaces corresponding to said plurality of reflection regions are created in order from a reflection region on the side of said light source towards a reflection region on the outside, or from a reflection region on the outside towards a reflection region on the side of said light source, such that adjacent ones of said segment surfaces are set according to a prescribed connection condition.

4. The method according to claim 1, wherein, in said reflection condition setting step, said reflection angle for each of said plurality of reflection regions is set to be zero or a negative angle as viewed from said optical axis.

* * * * *